United States Patent [19]

Fischer et al.

[11] 4,300,875

[45] Nov. 17, 1981

[54] POSITIVE DISPLACEMENT MACHINE WITH ELASTIC SUSPENSION

[75] Inventors: Berthold Fischer, Lechenich; Hans-Peter Kabelitz, Cologne; Hansen Pfaff, Erftstadt; Andreas Schmitz, Weilerswist, all of Fed. Rep. of Germany

[73] Assignee: Leybold-Heraeus GmbH, Cologne, Fed. Rep. of Germany

[21] Appl. No.: 57,996

[22] Filed: Jul. 16, 1979

[30] Foreign Application Priority Data

Jul. 15, 1978 [DE] Fed. Rep. of Germany ..... 2831179

[51] Int. Cl.[3] ..... F01C 1/02; F01C 21/00; F04C 25/02; F04C 18/02

[52] U.S. Cl. ..... 418/55; 418/56; 418/57; 418/178

[58] Field of Search ..... 418/55, 56, 57, 178

[56] References Cited

U.S. PATENT DOCUMENTS

| | | | |
|---|---|---|---|
| 2,475,247 | 7/1949 | Mikulasek | 418/55 |
| 2,966,860 | 1/1961 | Maynard | 418/178 |
| 3,011,694 | 12/1961 | Audemar | 418/55 |
| 3,323,497 | 6/1967 | Paschke | 418/57 |
| 3,600,114 | 8/1971 | Dvorak et al. | 418/55 |
| 3,817,664 | 6/1974 | Bennett et al. | 418/55 |
| 3,924,977 | 12/1975 | McCullough | 418/55 |
| 3,986,799 | 10/1976 | McCullough | 418/55 |

FOREIGN PATENT DOCUMENTS

| | | | |
|---|---|---|---|
| 2225327 | 5/1972 | Fed. Rep. of Germany | 418/178 |
| 2603462 | 8/1976 | Fed. Rep. of Germany | 418/178 |
| 2285531 | 4/1976 | France | 418/178 |
| 486192 | 5/1938 | United Kingdom | 418/178 |
| 1447607 | 8/1976 | United Kingdom | 418/178 |

*Primary Examiner*—John J. Vrablik
*Attorney, Agent, or Firm*—Spencer & Kaye

[57] ABSTRACT

In a displacement machine operating according to the spiral principle and having two displacement elements presenting respective axially interengaging sprial-shaped walls, and drive means connected between the elements to produce a relative translatory circular movement therebetween, an elastic suspension is provided to support at least one of the displacement elements for permitting elastic movement between the elements in a plane perpendicular to the axis of translatory circular movement.

In such a displacement machine, whether or not the elastic suspension is provided, the walls of the displacement elements are preferably made, at least at the surfaces contacting one another, of respectively different materials presenting a low mutual coefficient of friction.

3 Claims, 6 Drawing Figures

POSITIVE DISPLACEMENT MACHINE WITH ELASTIC SUSPENSION

BACKGROUND OF THE INVENTION

The present invention relates to a displacement machine, such as a compressor, vacuum pump or the like, operating according to the spiral principle and having two displacement elements presenting respective axially interengaging spiral-shaped walls or recesses, with one element performing a translatory, or non-rotating, circular movement relative to the other.

Compressors, vacuum pumps and other displacement machines operating according to the spiral principle have been known for some time and examples thereof are disclosed in German Auslegeschrift [Published Application] No. 2,225,327 and German Offenlegungsschrift [Laid-open Application] No. 2,603,462. The displacement process is effected by relative movement between two displacement elements each normally having some sort of base plate with a spiral-shaped wall or recesses disposed thereon. The spiral-shaped walls and recesses of both displacement elements then axially interengage. By means of a usually circular, but purely translatory relative movement, or parallel movement between the two displacement elements, the contact points between the spiral-shaped walls or recesses, respectively, move in the same sense so that, depending on the sense of rotation of the relative movement, the contact points travel on radii either from the outside to the inside or from the inside to the outside.

The driving or output, respectively, of such displacement machines is known to be effected in one of two ways. One displacement element may be stationary and the second element caused to perform, via an eccentric drive, usually a circular crank drive, the desired, usually circular relative movement. The second way, if circular relative movement is desired, is to rotatably mount both displacement elements with their axes of rotation offset by the desired eccentricity (e.g. involute pumps). Provided that the spiral walls and recesses extend over a segmental angle of at least $2\pi$, there exists a continuous radial contact between the spiral-shaped elements at least at one point. If the spiral-shaped walls and recesses extend at least twice around the circumference, i.e. circumscribe a segmental angle of at least $4\pi$, there always exist at least two radial points of contact. In the latter case, sickle-, or crescent-shaped cavities or areas form between two successive contact points, in which a fluid can be transported in one sense of direction due to the above-mentioned relative movement.

The conveying process in one sense of direction at low relative velocities of the displacement elements, where certain areal regions of the spiral walls and recesses are always associated only with either the suction or the high pressure side, permits the use of pumps and compressors operating according to the spiral principle wherever high compression ratios are to be attained without any or with only minimum lubrication. Displacement machines operating without oil are preferred for reasons of maintenance, operating costs and environmental impact. There also are cases where oil is not only undesirable but also not permissible, for example due to a danger of explosion.

It has been found, however, that the theoretically attainable high compression ratios and simple mode of operation are difficult to realize in practice because reliable and precise travel and sealing at the radial contact points between the spiral walls and recesses are difficult to accomplish. Further, if a clean force-free rolling of the contact points is not assured, the result is increased wear as well as local heating at the spiral contours and, connected therewith, the creation of cold welds and freezing of the bearings.

The main reason for insufficiently clean and force-free rolling of the contact points are:

(a) insufficient parallel guidance of the two displacement elements;

(b) insufficient manufacturing accuracy in the spiral contours; and (c) temperature caused contour deviations or elimination of play, respectively, at the spiral contours or at the contact points, respectively.

Known solutions to these problems include, inter alia, ultraprecise, adjustable crank drives as parallel guides, ultraprecise manufacture of the spiral contours in air-conditioned rooms, temperature control at the displacement elements by means of a refined cooling oil circulation, etc. Such solutions are disclosed, for example, in German Auslegeschrift No. 2,225,327. These solutions, however often entail much higher manufacturing costs than for pumps and compressors designed to be lubricated with oil, e.g. rotary slide vacuum pumps and the like. For that reason spiral displacement machines have so far found acceptance only where, for a lack of alternative solutions, the high costs seem acceptable.

SUMMARY OF THE INVENTION

It is an object of the present invention to provide a displacement machine which operates according to the spiral principle and has two displacement elements provided with axially interengaging spiral walls or recesses, respectively, and performing a translatory circular movement with respect to one another, which can be manufactured substantially more economically while maintaining high compression ratios.

This is accomplished according to the present invention by providing an elastic suspension for at least one of the two displacement elements. The elastically suspended displacement element is thus able to perform an escape movement which then allows for, within certain limits, inaccurate parallel guidance, inaccurate manufacture of the wall contours, thermal deformations and elimination of play, without negatively influencing the compression ratios.

The present invention can be used for displacement machines in which one displacement element is stationary and the other element is mounted on one or more crank drives having the same eccentricity, as well as for displacement machines in which both displacement elements are mounted to be rotatable about mutually offset axes.

In a displacement machine of the first-mentioned type, either the stationary or the moving displacement element, or both, may be elastically suspended. In a displacement machine of the second type, the elastic suspension of one or both of the two displacement elements may be effected, for example, by enclosing the bearings themselves by elastic elements.

It is particularly advisable for the elastic suspension to be prestressed in such a manner that the resulting bias force passes through the contact point or points between the two displacement elements and rotates in a suitable manner together with the contact point or points. This assures that aerodynamic forces resulting from the compression process and attacking the elastically suspended displacement elements cannot press the spiral walls apart so that contact between them is broken. When the aerodynamic forces produce this effect, the result is internal untightness of the displacement machine and thus worsening of the compression ratios. By stressing the elastic suspension in the given direction according to the invention, the contact between the walls or recesses, respectively, is constantly maintained.

Such a stressing may be produced, for example, by a matched excess of the crank radius of the driving and guiding cranks.

A further advantageous feature that can be realized even with displacement machines without elastic suspension of one or both of the displacement elements is that at least the contacting surfaces of the displacement elements are made of respectively different materials which are particularly suitable for the sliding action, i.e. which have a low coefficient of friction relative to one another. An advantageous pairing of materials is, for example, aluminum or steel on one displacement element and polytetrafluorethylene ("PTFE") with mineral or metallic fillers or structures on the other displacement element. These measures also permit economical manufacture of operable oil-free displacement machines.

Further advantages and details of the invention will be explained with reference to the drawing, in which preferred embodiments are schematically illustrated. Although the drawing only illustrates embodiments of the invention in which one of the displacement elements is stationary and the other performs a circular translatory movement, the described features of the present invention can also be used just as well for other displacement machines operating according to the spiral principle.

DESCRIPTION OF THE PREFERRED EMBODIMENTS

Figure 1:
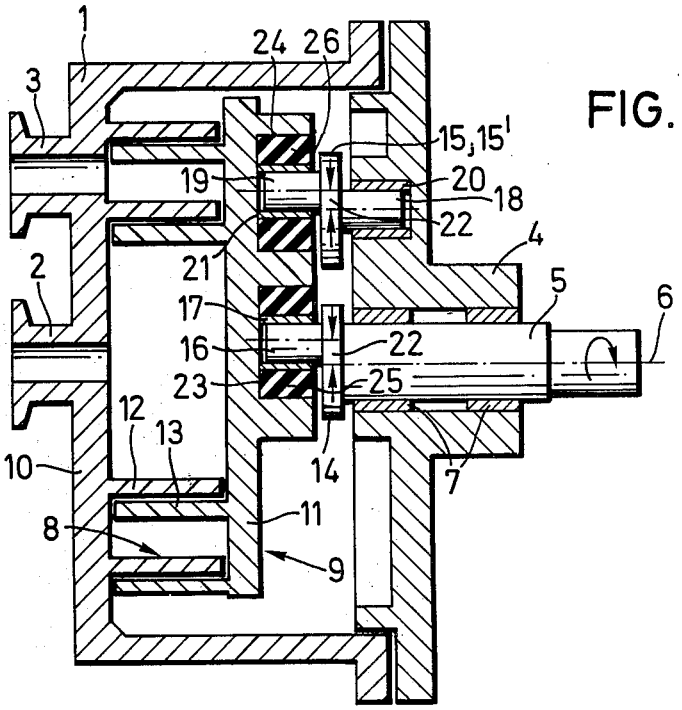
FIG. 1 is a cross-sectional side view of a displacement machine according to one preferred embodiment of the invention.

Each figure shows a housing composed of a cup-shaped portion 1 including inlet and outlet pipes 2 and 3, respectively, and a lid-shaped part 4 in which a drive shaft 5 is mounted. Shaft 5 rotates about an axis 6 and is supported by bearings 7, which are indicated only schematically.

Within the housing 1, 4 there are disposed a stationary displacement element 8 and a movable displacement element 9 which is mounted to perform a translatory circular movement, i.e. the entirety of element 9 moves around a circular path but does not rotate about an axis. Displacement element 8 is essentially composed of a disc 10 carrying a spiral-shaped wall 12 and element 9 is similarly composed of a disc 11 carrying a spiral-shaped wall 13. Each wall 12 and 13 defines a spiral recess and the walls are notched to, and interengage with, one another. The spiral walls 12 and 13 interengage to form spiral regions of limited extent which move from the inside toward the outside or from the outside toward the inside when element 9 is displaced over its circular path relative to element 8 so as to produce the conveying effect of the machine.

Figure 4:
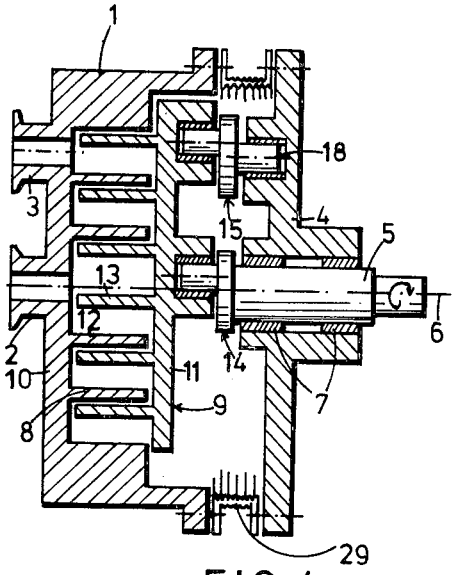
FIGS. 3–6 are views similar to that of FIG. 1 of machines according to further preferred embodiments of the invention.
Figure 3:
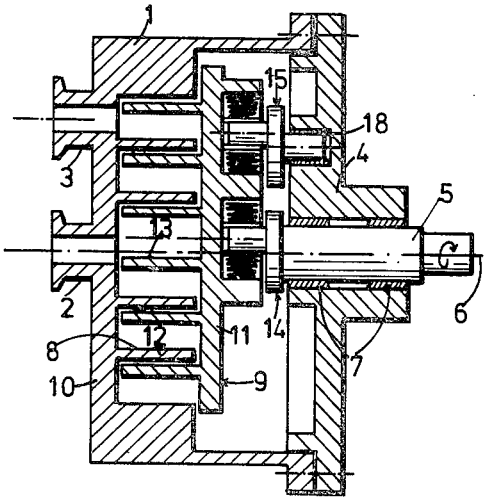

In the embodiments shown in FIGS. 1, 3 and 4, the disc 10 constitutes the bottom of the cup-shaped housing portion 1. The spiral walls 12 and the housing portion 1 are made in one piece.

Figure 2:
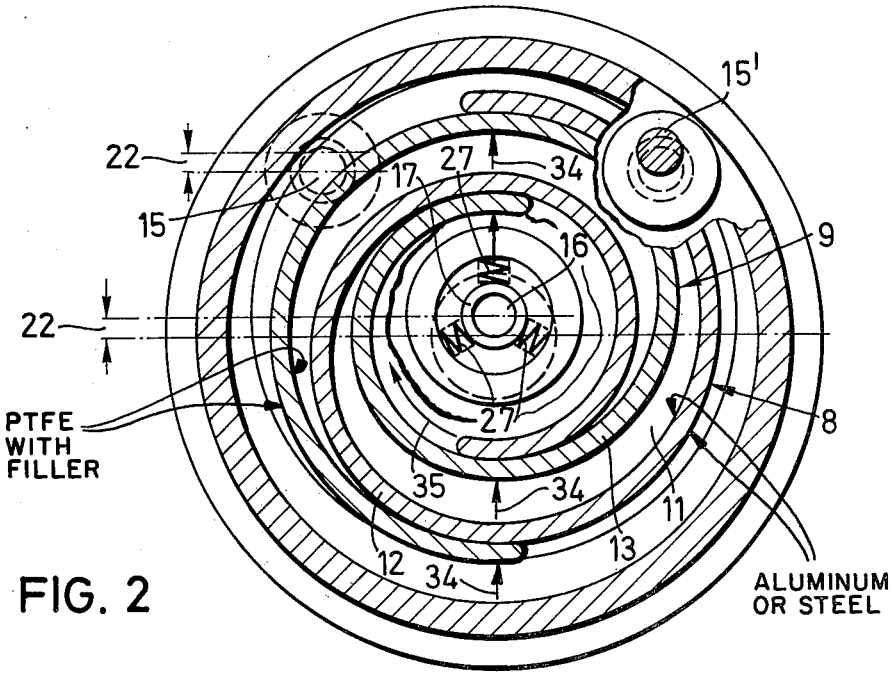
FIG. 2 is an axial, cross-sectional view of a modified version of the embodiment of FIG. 1.

In order for the movable displacement element 9 to be able to perform a translatory circular movement, a drive crank 14 coupled with the shaft 5 and at least one guide crank 15 are provided. For this purpose, the drive shaft 5 is provided at the driven side with a shaft stem 16 which is eccentric with respect to the axis 6 and which is mounted in a bearing sleeve 17 in displacement element 9. The guide crank 15 includes a shaft stem 18 at its driving end and a shaft stem 19, eccentric to stem 18, at its driven end, each stem 18 and 19 being mounted in a respective bearing sleeve 20 or 21. The magnitude of the eccentricity is shown in FIGS. 1 and 2 by the double arrow 22 and is the same for both cranks.

In the embodiment of FIG. 1, the present invention is realized in that the shaft stems 16 and 19 at the driven end are elastically mounted in the movable displacement element 9. For this purpose, displacement element 9 is provided with bearing bushes 23 and 24 in which engage bearing sleeves 17 and 21 of the shaft stems 16 and 19, respectively, at the driven ends of cranks 14 and 15. The inner diameters of the bearing bushes 23 and 24 are selected so that, in addition to the shaft stems 16 and 19 and bearing sleeves 17 and 21, elastic elements 25 and 26 which surround the shaft stems can also be accommodated in bushes 23 and 24, respectively. As a result of these elastic elements, the displacement element 9 is capable of performing escape movements required due to inaccurate parallel guidance, imprecise contour manufacture or thermal deformation or elimination of play.

The elastic elements 25 and 26 in the embodiment of FIG. 1 are of rubber or an elastomer. Of course it is also possible to replace this ring by, for example, radially oriented helical springs, corrugated spring rings or the like. The important thing is the substantial elasticity of the elements surrounding the bearing.

The elastic elements are so dimensioned that the gas loads generated in radial direction are compensated in any operational state of the pump.

Design, size and material of the elastic elements are adapted to the specific applications of the pump.

FIG. 2 is a cross-sectional view of a modification of the embodiment of FIG. 1. In this embodiment three diametrically opposed helical springs 27 serve as the elastic element cooperating with stem 16. For reasons of stabilization, however, four or even more springs are advisable. For reasons of clarity the springs are shown only in the region of the drive crank 14. There are provided two further guide cranks 15 and 15' which are shown only in broken lines, and each of which can similarly be provided with two helical springs serving as the associated elastic element.

As discussed previously with regard to the advantages of the invention, at least the contacting surfaces of the displacement elements are made of respectively different materials which are particularly suitable for sliding action, i.e., materials which have a low coefficient of friction relative to one another. Exemplary materials, e.g., PTFE with mineral or metallic fillers, aluminum, or steel, are identified in FIG. 2. Of course, it is not important that stationary displacement element 8 have surfaces of aluminum or steel and that moveable displacement element 9 have surfaces of PTFE with fillers, as long as at least the surfaces of the elements are of respectively different materials suitable for the sliding action.

In the embodiment of FIG. 3, helical springs are also provided as the elastic elements for the drive crank 14 as well as for the guide crank, or cranks, 15.

The elastic suspension for the movable displacement element 9 can also be established by elastically suspending the entire cover-shaped housing portion 4. FIG. 4 shows such an embodiment. Here the elastic suspension of the cover 4 is provided by a continuous bellows 29 mounted between the stationary housing portion 1 and the cover 4.

Figure 6:
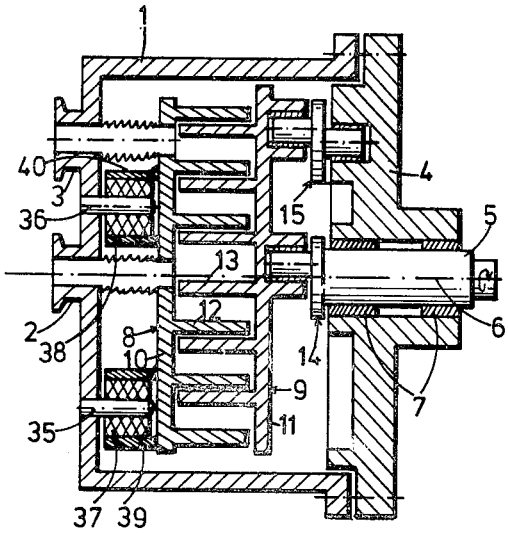
Figure 5:
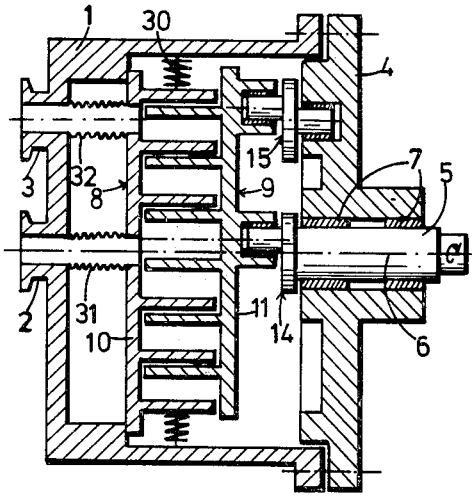

It is further possible, within the scope of the present invention, to elastically suspend the nominally stationary displacement element 8 so that it permits the desired compensatory movement. Embodiments of this type are shown in FIGS. 5 and 6. In the embodiment of FIG. 5, the displacement element 8 is shown as a component which can move independently of housing portion 1 and which is held in the housing portion 1 by means of a plurality of radially oriented helical springs 30. Bellows 31 and 32 are provided for the intake and discharge, respectively, of the conveyed medium.

In the embodiment of FIG. 6 the displacement element 8 is held by pins 35 and 36 which are oriented parallel to the drive axis 6 and which support associated rings 37 and 38 of elastic material. These rings are themselves surrounded by sleeves 39 and 40 which are firmly connected to the displacement element 8 so that there results an elastic suspension as a whole. While only two pins 35 and 36 and associated suspension elements are shown, it would be advisable in practice to provide three equispaced suspension units.

FIG. 2 will be referred to to explain a further preferred embodiment of a displacement machine according to the invention. As already mentioned, there exists the danger that the compression ratios of such a machine are worsened due to the fact that the spiral walls of the displacement elements which move relative to one another lose contact with one another. For that reason it is advisable to tension the elastic suspension in such a manner that the resulting bias force always has a component which extends in a direction such that it passes through the contact point or points between the two walls 12 and 13 of the displacement elements 8 and 9. This can be done, for example, by making the magnitude of the eccentricity 22 determined by the drive and guide cranks somewhat greater than the radial movement permitted by the spiral walls or the displacement elements per se. This excess in the crank radius can be selected so that a force which presses the wall 13 in the direction of the arrows 34 in the areas of the respective contact points toward the wall 12 of the stationary displacement element 8 constantly acts on the wall 13 of the displacement element 9. During operation of the pump, element 9 moves in the direction shown by the arrow 35, the locations of the contact points between walls 12 and 13, and thus arrows 34, rotate together with the cranks. Thus, it is assured that this force always acts in such a manner in the area of the likewise rotating contact points that contact is always assured.

It will be understood that the above description of the present invention is susceptible to various modifications, changes and adaptations, and the same are intended to be comprehended within the meaning and range of equivalents of the appended claims.

What is claimed is:

1. In a displacement machine operating according to the spiral principle and having a stationary housing, two displacement elements within said stationary housing presenting respective axially interengaging spiral-shaped walls, at least one crank drive connected to produce a relative translatory circular movement therebetween, one of said elements forming a rigid unit with said housing, the other element being connected to be driven by said crank drive, the improvement comprising means defining an elastic suspension disposed between said other displacement element and said crank drive for supporting the other element thereby permitting elastic movement between said elements in a plane perpendicular to the axis of translatory circular movement, and wherein said crank drive includes an output component connected to drive one of said displacement elements and constructed to follow a path having a radius greater than that of the relative circular movement between said displacement elements, thereby to prestress said suspension means in such a manner as to produce a bias force in a direction which passes through a contact point between said two displacement elements and which rotates together with the contact point during the relative circular movement, and wherein said displacement elements are made, at least at the mutually contacting surfaces thereof, of respectively different materials having a low coefficient of friction therebetween, to promote smooth sliding therebetween.

2. Displacement machine as defined in claim 1 wherein said crank drive comprises a shaft stem having an axis eccentric to the fixed rotation axis of said drive means, and said suspension means comprise a spring element having a cylindrical form and interposed between said driven element and said shaft stem.

3. Displacement machine as defined in claim 1 wherein the material at the contacting surface of one of said displacement elements is aluminum or steel and the material at the contacting surface of the other of said displacement elements is polytetrafluoroethylene with mineral or metallic fillers.

* * * * *